US006789693B2

(12) United States Patent
Lassiter

(10) Patent No.: US 6,789,693 B2
(45) Date of Patent: Sep. 14, 2004

(54) TWO-LITER COOLER

(76) Inventor: Milton Lassiter, 440 Foster St., Cornelia, GA (US) 30531

( * ) Notice: Subject to any disclaimer, the term of this patent is extended or adjusted under 35 U.S.C. 154(b) by 189 days.

(21) Appl. No.: 10/163,761

(22) Filed: Jun. 5, 2002

(65) Prior Publication Data

US 2003/0015538 A1 Jan. 23, 2003

Related U.S. Application Data

(60) Provisional application No. 60/303,668, filed on Jul. 6, 2001.

(51) Int. Cl.[7] ..... B65D 81/38

(52) U.S. Cl. ..... 220/592.18; 220/592.25

(58) Field of Search ..... 220/592.09, 592.1, 220/592.2, 592.25, 592.17, 592.18, 592.19

(56) References Cited

U.S. PATENT DOCUMENTS 2,147,886 A * 2/1939 Devine ..... 206/545
3,420,363 A * 1/1969 Blickensderfer ..... 206/524
3,848,766 A * 11/1974 Gantt et al. ..... 206/139
4,119,248 A * 10/1978 Butler et al. ..... 224/148.3
4,194,619 A * 3/1980 Schley ..... 206/217
4,228,908 A * 10/1980 Tweeton ..... 215/11.6
5,261,554 A * 11/1993 Forbes ..... 220/592.16
5,325,988 A * 7/1994 Ekern ..... 220/592.25
6,244,458 B1 * 6/2001 Frysinger et al. ..... 220/592.09
6,481,239 B2 * 11/2002 Hodosh et al. ..... 62/457.4

* cited by examiner

*Primary Examiner*—Joseph Man-Fu Moy
(74) *Attorney, Agent, or Firm*—Troutman Sanders LLP; Ryan A. Schneider

(57) ABSTRACT

An improved temperature control device for maintaining the temperature of the contents of a beverage receptacle. The device is designed to keep a contained two-liter bottle cold for long periods of time. The device includes an annular column formed from insulating material encased within a durable sheath. The annular column defines a cylindrical container for placement of the two-liter bottle. A cover is included enclosing the two-liter bottle within the container. The cover is also formed from an insulating material and enclosed within a durable sheath. An outer wrap surrounds the cover and container, hingedly attaching the cover to the container so that the cover is removably securable. The outer wrap additionally includes a zipper, enabling the nylon wrap to be opened or closed, fastening the cover to the cylindrical container. The device also includes a variety of carrying straps that are removable from the outer wrap for ease and convenience.

19 Claims, 3 Drawing Sheets

TWO-LITER COOLER

RELATED APPLICATION

This application claims priority based on Provisional Patent Application No. 60/303,668 filed Jul. 6, 2001 and entitled "Two-Liter Cooler".

FIELD OF THE INVENTION

The present invention relates generally to insulated coolers, and specifically to a thermally insulated device designed to keep a two-liter bottle of liquid satisfactorily cold for approximately six hours or more.

BACKGROUND OF THE INVENTION

The two-liter bottle has become a standard and popular container for holding all types of liquids. While the two-liter bottle is lightweight and shatter-resistant, such containers have a limited ability to maintain the temperature of the liquids they contain. Thermal devices have been formed in many shapes and sizes in attempts to maintain these liquids at a desired temperature. For instance, Thermos® brand vacuum containers are world renowned for keeping coffee hot, and iced tea cold. It is also customary to place a beverage container inside an ice chest in order to keep the liquid in the beverage container cool. While it is known to keep poured liquids cool in a Thermos® brand vacuum container, or two-liter bottles of liquid cool in a chest of ice, there are relatively few references disclosing devices or methods to keep a two-liter bottle of liquid cool in a rugged, yet lightweight, outer container. Yet such a container would enable an entire two-liter bottle to be pulled out of the container either to be recycled when emptied, or to be placed back into the refrigerator upon return home from a picnic.

Vacuum containers are useful, but the contents of the two-liter bottle must be poured into the container, and thus wasted if not fully consumed. Further, the mere act of pouring out the contents of the two-liter bottle into the vacuum container significantly reduces the amount of carbonation in, for example, the poured soda and generally causes the soda to become flat, thus ruining the soda's flavor. Further, vacuum containers are not rugged and quite susceptible to damage unless surrounded by a thick and sometimes heavy insulated jacket. Large Styrofoam® block type coolers are also inadequate for cooling two-liter bottles. They are cumbersome to carry and require bags of ice which add expense and weight to the endeavor. Using typical plastic type pitchers filled with ice is also inadequate, because as the ice melts, the beverage becomes watered down.

Representative patents of portable coolers include U.S. Pat. Nos. 5,148,682 to Wolf and 4,338,795 to House Jr. describing devices and methods for forming ice around bottled beverage containers. U.S. Pat. No. 4,164,851 to Bryant describes a motorized unit that will rapidly cool a canned or bottled beverage by spinning the beverage container in ice creating a frictional contact between the container and the ice within the cooling compartment.

Other variations of coolers have been proposed for reducing the need for ice or motorized units. One such variation is to pre-freeze the portable cooler itself prior to use. For example, U.S. Pat. No. 5,406,808 to Babb et al. discloses a threaded top two-liter bottle cooler/insulator that is placed into a freezer prior to use. Whereas, U.S. Pat. No. 5,555,746 to Thompson describes a multi-piece insulated cooler, wherein each piece is pre-frozen before use.

Another cooling technique is to replace conventional ice with another type of freezable material. U.S. Pat. No. 5,444,992 to Bell discloses a cooler that uses ice blocks to keep a two-liter bottle cool, which ice blocks must be placed in a freezer and frozen prior to use. While, U.S. Pat. No. 5,904,267 to Thompson is a complex device formed from molded plastic and having solid side walls or double co-axial side walls filled with Blue Ice®, frozen water and the like to retain temperature.

U.S. Pat. No. 4,811,858 to Augur, the combination single bottle cooler and liquid container, duplicates some characteristics in other containers by combining base, shoulder, and cap portions formed from thermal insulation material. Such a combination eliminates the need for ice, but can be complicated to use as extra parts may be lost or misplaced.

As is clear, many of the above referenced insulators are heavy and cumbersome, perhaps useful on a nearby picnic, but certainly not on a camping trip. Other insulators must be pre-frozen or filled with ice or ice-substitutes in order to keep contents cool. Yet this severely hampers the ease of use of these types of insulators. Many coolers also have more than one integral piece, yet with each additional piece, the chances rise that one or more of the separate pieces will be lost.

Therefore, it can be seen that a need yet exists for a temperature control device designed to keep a two-liter bottle cold, being lightweight yet durable, and capable of overcoming the numerous disadvantages in other designs. It is to such a cooling device that the present invention is primarily directed.

BRIEF SUMMARY OF INVENTION

Briefly described, in a preferred form, the present invention is an innovative temperature control device designed to keep a contained two-liter bottle cold for long periods of time. The present temperature control device comprises an annular column of one-inch styrene encased within a flexible liner of styrene. The annular column of styrene forms a container having an interior cavity for placement of the two-liter bottle. The column of styrene also has a cover of the same. The exterior portion of the polyvinyl chloride is additionally covered by a 1000 denier nylon wrap.

The present preferred temperature control device is cylindrical in shape, measures 14¼" in height and 6⅞" in diameter, and includes hand and shoulder straps for upright carrying, plus additional straps for the convenience of a backpacker. The cover of the device is hingedly connected to the container via the nylon wrap, and opens easily to enable the sliding within of a two-liter bottle. The nylon wrap additionally includes a zipper, enabling the nylon wrap to be opened or closed, fastening the cover to the cylindrical container. The entire device is light weight, weighing only 11.4 oz., including handles, straps and friction type clamp buckles.

It will be apparent to those skilled in the art that the innovation is not limited to keeping two-liter bottles cold or to the fields of sporting events, camping, and backpacking. Other embodiments are also possible without departing from the scope of the invention. Additional features and advantages of the temperature control device disclosed herein are apparent from, or will be set forth in, the detailed descriptions provided hereinafter.

A principle object of the present invention is to provide an insulated cooler capable of maintaining inserted receptacles of liquid at substantially constant temperatures.

It is another object of the present invention to provide a lightweight but durable cooler that can easily be carried by a backpacker.

Yet another object of the present invention is a lightweight unit capable of keeping a beverage cold during outings or sporting events.

These and other objects, features and advantages of the present invention will become more apparent upon reading the following specification in conjunction with the accompanying drawings.

DETAILED DESCRIPTION OF A PREFERRED EMBODIMENT

Figure 1:
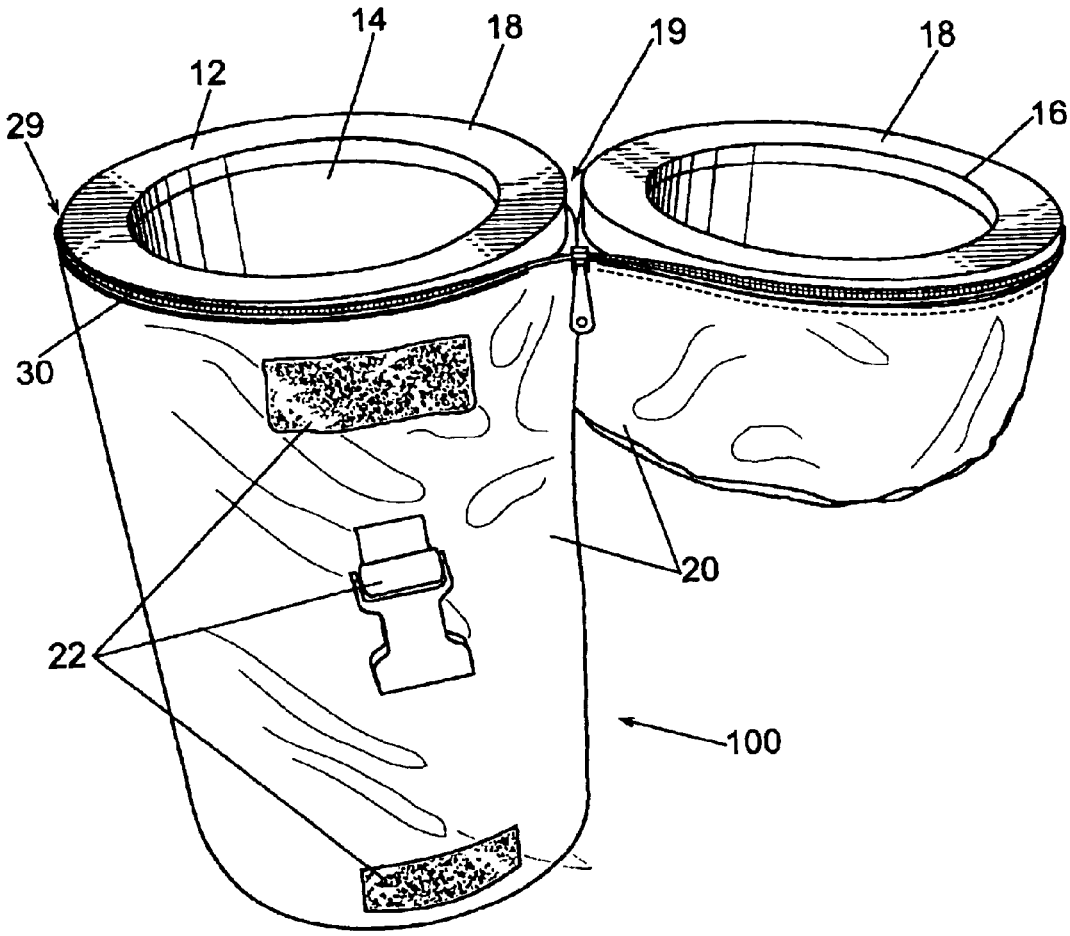
FIG. 1 is a perspective view of a preferred embodiment of the present invention demonstrating the device in an open position.

Referring now in detail to the drawing figures, wherein like reference numerals represent like parts throughout the several views, FIG. 1 depicts a perspective view of a preferred embodiment of the present temperature control device 100 designed to keep the contents of a two-liter bottle (not shown) cold for a prolonged period of time. While the present temperature control device 100 is described herein as designed for a two-liter bottle, it will be understood by those of skill in the art that the design is adaptable to numerous configurations and/or shapes. For example, the present invention can be designed to hold a carton of milk, a juice box, a can of soda, or receptacles with other shapes and/or volumes.

The temperature control device 100 of FIG. 1 comprises a container 12 having an interior cavity 14, a cover 16 and a securing mechanism 19. The securing mechanism 19 ensures that cover 16 cannot be lost from container 12 when cavity 14 is exposed, thus cover 16 is at least removably securable to container 12, but alternatively can be fixedly securable to container 12. In a preferred embodiment, a durable nylon wrap 20 functions as the securing mechanism 19 to hingedly secure cover 16 to container 12, while further improving the overall durability of temperature control device 100.

The temperature control device 100 of FIG. 1 is shown in an open position depicting the interior cavity 14 of container 12 for holding a two-liter bottle with cover 16 being capable of enclosing the two-liter bottle within container 12. In a preferred embodiment, the container 12 cover 16 are constructed from an insulating material and are capable of maintaining the contents of a two-liter bottle at a cool temperature without the need of additional ice blocks. Container 12 and cover 16 are preferably constructed from one-inch styrene insulation, although insulating materials such as polystyrene, polyurethane, polyisocyanurate, fiberglass and cellulose. Container 12 and cover 16 can additionally be enclosed within a sheath 18 made of polyvinyl chloride which can increase insulation, add durability, and water-proof temperature control device 100. Alternatively, sheath 18 may be constructed of, for example, polyethylene or polypropylene.

The manufacturing of temperature control device 100 can be simplified by adding an insert for placement into the cavity 14 of container 12 to function as additional insulating material and/or adjust the volume of cavity 14. Thus, temperature control device 100 can be adapted for holding containers of different configurations or shapes with the insert. For instance, another embodiment of temperature control device 100 designed to hold a three-liter bottle can include an insert to adjust the device so that it can alternatively hold a two-liter bottle.

The temperature control device 100 of FIG. 1 can also include a fastening mechanism 29 to further fasten cover 16 to container 12, improving the overall insulating ability of device 100. In a preferred embodiment, fastening mechanism 29 is a zipper 30 on wrap 20 beginning at securing mechanism 19 and encircling cover 16 and container 12. Thus zipper 30 is capable of completely closing wrap 20 around cover 16 and container 12, sealing a two-liter bottle within temperature control device 100.

The present temperature control device 100 can further comprise attachment mechanisms 22 to allow the attachment of various carrying mechanisms 23 (FIGS. 3 and 4), thus increasing the portability and ease of use of temperature control device 100. In the preferred embodiment of FIG. 1, the attachment mechanisms 22 are located on the exterior of wrap 20 and are preferably a combination of Velcro® strips and squeeze type clips, but a person of ordinary skill in the art will recognize that other attachment mechanisms 22 can be substituted consistent with the spirit and scope of the invention.

Figure 2:
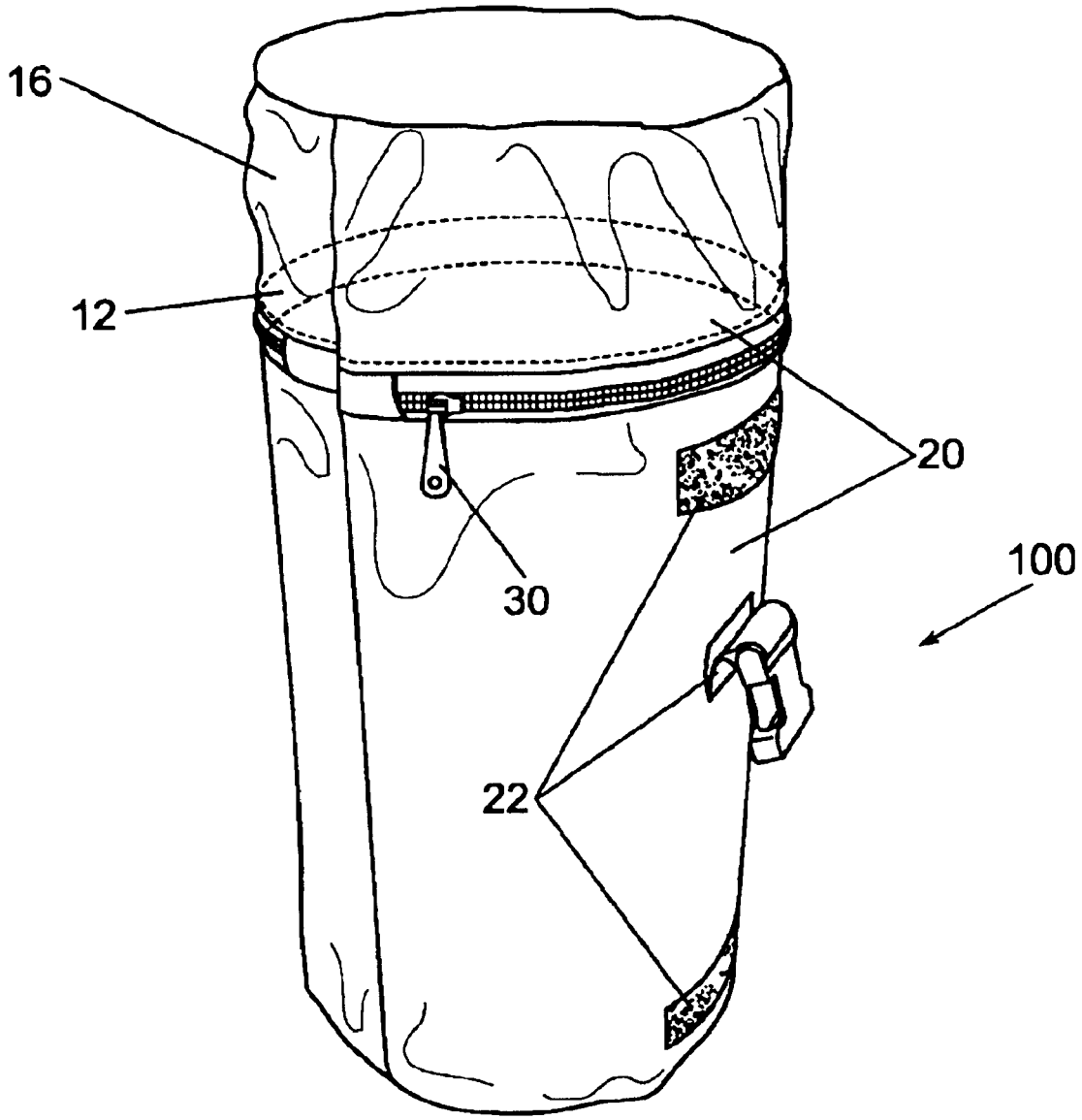
FIG. 2 is a perspective view of a preferred embodiment demonstrating the device in a closed position.

FIG. 2 illustrates another perspective view of the preferred embodiment shown in FIG. 1, depicting wrap 20 enclosed around cover 16 and container 12. In a closed position, cover 16 is completely fastened to container 12 by securing mechanism 19 and zipper 30 of wrap 20. Attachment mechanisms 22 are also provided on the exterior of wrap 20 to allow attachment of various carrying mechanisms 23 (FIGS. 3 and 4) such as a strap, handle, or loop.

Figure 3:
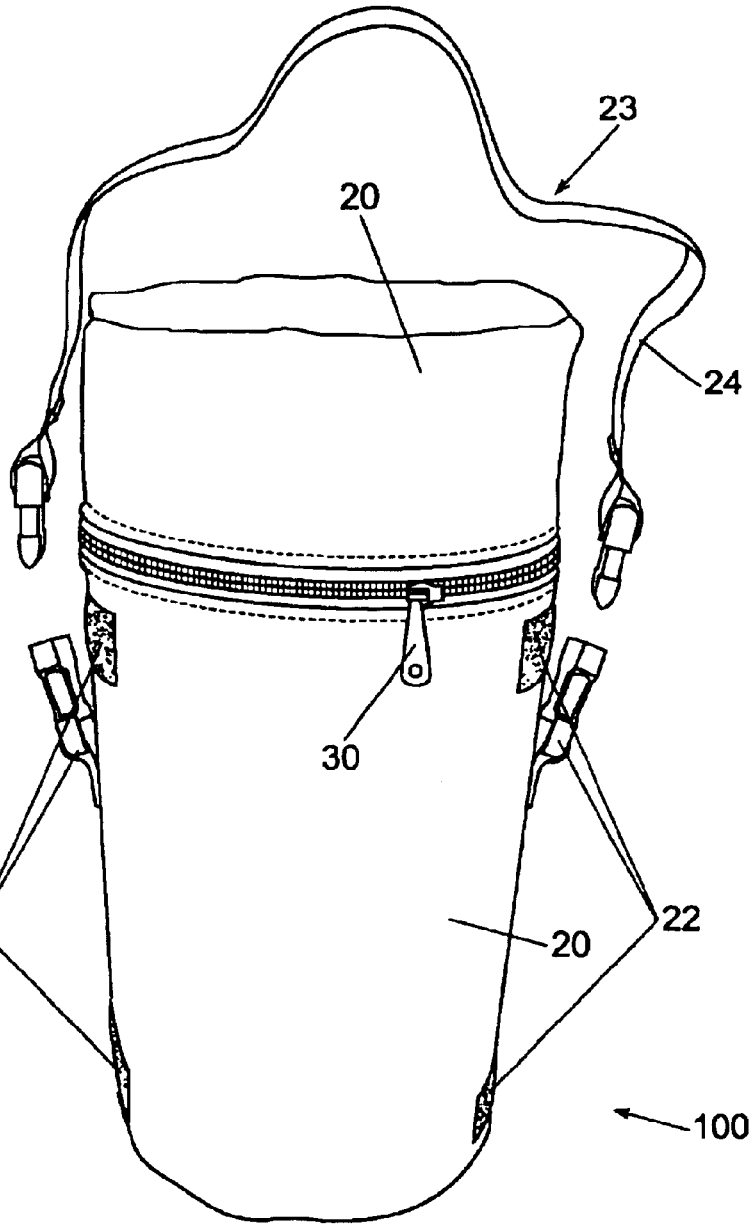
FIG. 3 is a front view of the preferred embodiment of FIG. 2.

FIG. 3 depicts a front view of the preferred embodiment of FIG. 2. Temperature control device 100 is shown with wrap 20 closed by zipper 30. In a preferred embodiment, hand strap 24 functions as carrying mechanism 23 and may be attached to, or detached from, temperature control device 100 by the attachment mechanisms 22 mounted on wrap 20.

Figure 4:
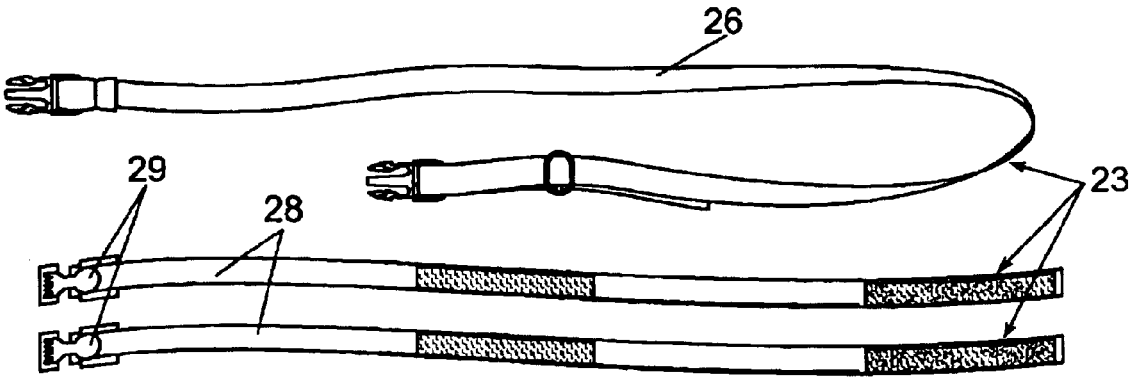
FIG. 4 is a perspective view of additional carrying straps for use with the preferred embodiment in FIGS. 1 and 2.

Additional carrying straps are shown in FIG. 4 for use with a preferred embodiment of temperature control device 100. The additional carrying straps can include an adjustable shoulder strap 26 and a pair of backpacking straps 28 to provide varying methods of carrying temperature control device 100. The pair of backpacking straps 28 can further include friction type buckles 29, making them adjustable for further convenience.

Tests have been conducted on temperature control device 100 using a two-liter bottle and indicate that its unique design as disclosed herein keeps the contents of a pre-chilled two-liter bottle chilled, unexpectedly, for several hours. A chilling ratio $C_R$ was developed to determine the effectiveness of various coolers. The chilling ratio takes into account the ambient temperature $T_A$, the pre-chilled temperature $T_{PC}$, and the actual liquid temperature $T_L$ of the contents of the bottle after a certain length of time the bottle is kept in the cooler. The chilling ratio is between zero and one, with zero being the most effective cooler, and one being the least effective cooler.

$$C_R=(T_{L-TPC})/(T_A-T_{PC}) \quad (1)$$

Equation (1) illustrates that if the temperature of the contents of the bottle is the same as the ambient temperature, the $C_R$ equals one, suggesting the cooler did nothing to keep the contents of the bottle cooler than ambient. On the other hand, if the temperature of the contents of the bottle is the same as the pre-chilled temperature, then the cooler maintained the temperature of the contents of the bottle at the same temperature as the pre-chilled temperature, notwithstanding the ambient temperature. The lower the $C_R$, the more efficient the cooler.

In one test, a two-liter bottle was filled with water and pre-chilled to a temperature of 37° F. After thermal stabilization, the bottle was then placed within a preferred embodiment of temperature control device 100 and put into an environmental chamber for six hours. This procedure was performed three times with the environmental chamber programmed to maintain ambient temperatures of 68° F., 78° F., and 88° F. respectively. After six hours, the temperature of the water was measured providing the following results:

| Recorded Temperature of the Water (° F.) | | | |
|---|---|---|---|
| $T_{PC}$ | 37° F. | 37° F. | 37° F. |
| $T_A$ | 68° F. | 78° F. | 88° F. |
| $T_L$ (after 6 hours): | 45.7° F. | 51.0° F. | 54.0° F. |
| $C_R$ | .28 | .34 | .33 |

As is clearly evident from these tests, even if the present device 100 is used in the outdoors at temperatures nearing 90° F., the contents of a pre-cooled two-liter bottle will remain refreshingly cool even after six hours.

The present device 100 is designed for casual use as well as outdoor activities. The entire unit is lightweight, weighing only 11.4 oz. total in a preferred form, including a hand held strap 24 (FIG. 3), an adjustable shoulder strap 26 (FIG. 4) and backpack straps 28 (FIG. 4). For further convenience, the straps may be attached or detached from temperature control device 100 by the use of various attachment mechanisms 22 (FIGS. 1–3) mounted on wrap 20 (FIGS. 1–3). This truly unique design makes the preferred embodiment a reliable cooler that is a lightweight, yet durable device that can be conveniently carried in a variety of ways.

Numerous characteristics and advantages have been set forth in the foregoing description, together with details of structure and function. While the invention has been disclosed in its preferred form, it will be apparent to those skilled in the art that many modifications, additions, and deletions, especially in matters of shape, size, and arrangement of parts, can be made therein without departing from the spirit and scope of the invention and its equivalents as set forth in the following claims. Therefore, other modifications or embodiments as may be suggested by the teachings herein are particularly reserved especially as they fall within the breadth and scope of the claims here appended.

What is claimed is:

1. A temperature control device for the contents of a pre-chilled beverage receptacle, the device comprising:

a container having an outer surface and an inner surface, the container having an interior cavity adapted to receive a pre-chilled beverage receptacle, wherein the contents of the pre-chilled beverage receptacle are at a pre-chilled temperature $T_{PC}$;

a cover having an outer surface and an inner surface, the cover adapted to enclose a beverage receptacle within the interior cavity of the container; and a securing mechanism attaching the cover to the container, wherein the outer surfaces of the temperature control device are subject to ambient conditions having an ambient temperature $T_A$, wherein a chilling ratio $C_R$ is defined as $(T_L-T_{PC})/(T_A-T_{PC})$, $T_L$ being the temperature of the contents of the pre-chilled beverage receptacle after some time t has passed with the pre-chilled beverage receptacle in the device, and wherein the chilling ratio $C_R$ is less than 0.5 when t equals approximately six hours.

2. The temperature control device of claim 1, wherein the securing mechanism comprises:

a wrap surrounding the container and the cover, wherein the wrap hingedly attaches the cover to the container, such that the cover is removably securable to the container.

3. The temperature control device of claim 2, wherein the container is formed from a first insulating material and the cover is formed from a second insulating material.

4. The temperature control device of claim 3, wherein the first and second insulating materials of the container and cover are individually enclosed within a sheath of durable material.

5. The temperature control device of claim 4, wherein the device further comprises:

a fastening mechanism to close and fasten the cover on the container.

6. The temperature control device of claim 5, wherein the fastening mechanism comprises:

at least one zipper mounted on the wrap, wherein the wrap may be opened and closed, removably closing the wrap and fastening the cover to the container.

7. The temperature control device of claim 6, wherein the device further comprises:

a carrying mechanism, wherein the device may be carried.

8. The temperature control device of claim 7, wherein the device further comprises:

an attachment mechanism for attaching the carrying mechanism to the device, wherein the carrying mechanism may be attached or detached from the device.

9. The temperature control device of claim 8, wherein the attachment mechanism is mounted on the wrap.

10. The temperature control device of claim 9, wherein the carrying mechanism comprises:

at least one hand strap;

at least one adjustable shoulder strap; and a pair of backpacking straps.

11. The temperature control device of claim 10, wherein the container is a substantially annular column.

12. The temperature control device of claim 11, wherein the cover is sizably adapted to mate with the annular column.

13. A temperature control device for a beverage receptacle, the device comprising:

a container formed from a first insulating material, the container being individually encased within a sheath of a first durable material and forming an interior cavity adapted to receive a beverage receptacle;

a cover formed from a second insulating material, the cover being individually encased within a flexible and durable material and adapted to enclose a beverage container within the container; and a securing mechanism attaching the cover to the container, wherein a liquid within the beverage receptacle is at a temperature $T_{PC}$ when the beverage receptacle is placed within the device, wherein the device is subject to ambient conditions having an ambient temperature $T_A$, wherein a chilling ratio $C_R$ is defined as $(T_L-T_{PC})/(T_A-T_{PC})$, $T_L$ being the temperature of the contents of the beverage receptacle after some time t has passed with the beverage receptacle in the device, and wherein the chilling ratio $C_R$ is less than 0.5 when t equals approximately six hours.

14. The temperature control device of claim 13, wherein the securing mechanism comprises:

a wrap surrounding the container and the cover, wherein the wrap hingedly attaches the cover to the container, such that the cover is removably securable to the container.

15. The temperature control device of claim 14, wherein the device further comprises:

a fastening mechanism to close and fasten the cover on the container.

16. The temperature control device of claim 15, wherein the device further comprises:

a carrying mechanism, wherein the device may be carried.

17. The temperature control device of claim 16, wherein the device further comprises:

an attachment mechanism for attaching the carrying mechanism to the device, wherein the carrying mechanism may be attached or detached from the device.

18. The temperature control device of claim 17, wherein the carrying mechanism comprises:

at least one hand strap;

at least one adjustable shoulder strap; and a pair of adjustable backpacking straps having friction type buckles.

19. The temperature control device of claim 18, wherein the fastening mechanism comprises:

a zipper mounted on the wrap, such that the wrap may be opened or closed, removably fastening the cover to the container.

* * * * *